US008769824B2

(12) United States Patent
Heerlein et al.

(10) Patent No.: US 8,769,824 B2
(45) Date of Patent: Jul. 8, 2014

(54) ANIMAL SHEARING MACHINE

(75) Inventors: Matthias Heerlein, St. Kilian (DE); Daniel Weber, Reute (DE)

(73) Assignee: Aesculap Suhl GmbH, Suhl (DE)

( * ) Notice: Subject to any disclaimer, the term of this patent is extended or adjusted under 35 U.S.C. 154(b) by 442 days.

(21) Appl. No.: 13/274,554

(22) Filed: Oct. 17, 2011

(65) Prior Publication Data

US 2012/0090182 A1 Apr. 19, 2012

Related U.S. Application Data

(63) Continuation of application No. PCT/EP2010/054940, filed on Apr. 15, 2010.

(30) Foreign Application Priority Data

Apr. 20, 2009 (DE) ..... 10 2009 017 517
Oct. 9, 2009 (DE) ..... 10 2009 045 545

(51) Int. Cl.
*B26B 19/24* (2006.01)
*B26B 19/28* (2006.01)

(52) U.S. Cl.
USPC ..... 30/43.92; 30/216

(58) Field of Classification Search
USPC ..... 30/43–43.92, 216
See application file for complete search history.

(56) References Cited

U.S. PATENT DOCUMENTS 1,997,096 A * 4/1935 Andis ..... 30/199
2,292,453 A * 8/1942 La Mere ..... 30/216
2,876,538 A 3/1959 Wahl et al.
3,003,093 A * 10/1961 Walters ..... 318/134
3,136,058 A * 6/1964 Andis ..... 30/210
3,222,781 A * 12/1965 Luther et al. ..... 30/210
3,279,062 A * 10/1966 Andis ..... 30/210
3,570,122 A * 3/1971 Williams ..... 30/210
3,589,007 A * 6/1971 Walton ..... 30/140
3,992,778 A * 11/1976 Urbush ..... 30/216
4,328,616 A * 5/1982 Andis ..... 30/225
4,383,366 A * 5/1983 Andis ..... 30/221
4,394,082 A * 7/1983 Senuma et al. ..... 396/488
4,700,476 A * 10/1987 Locke et al. ..... 30/43.91
4,723,362 A 2/1988 Boerger
4,725,160 A * 2/1988 Wood ..... 403/95

(Continued)

FOREIGN PATENT DOCUMENTS

DE 63053 7/1892
DE 11 96 994 7/1965

(Continued)

*Primary Examiner* — Sean Michalski
(74) *Attorney, Agent, or Firm* — Lipsitz & McAllister, LLC

(57) ABSTRACT

The invention relates to an animal shearing machine with a housing, a shearing head connected to the housing and a drive unit arranged in the housing. The drive unit comprises an electric motor and a reduction gear connected to the shaft of the electric motor. The shearing head of the animal shearing machine has a stationary shearing blade and a movable shearing blade. A planetary gear is used as reduction gear. The driven shaft of the planetary gear is arranged parallel, in particular coaxially to the shaft of the electric motor. If oscillatingly driven shearing heads are used, the drive unit comprises an eccentric connected to the driven shaft of the reduction gear and an oscillating lever. The oscillating lever is in engagement with the movable shearing blade via the first front end and with the eccentric via a sliding element in the area of the second rear end.

27 Claims, 4 Drawing Sheets

(56) References Cited

U.S. PATENT DOCUMENTS

| | | | | |
|---|---|---|---|---|
| 4,827,616 | A * | 5/1989 | Sistare | 30/210 |
| 4,985,719 | A * | 1/1991 | Tsurukawa et al. | 396/529 |
| 4,996,826 | A * | 3/1991 | Pfaffmann et al. | 53/478 |
| 5,025,123 | A * | 6/1991 | Pfaffmann et al. | 219/604 |
| 5,068,966 | A * | 12/1991 | Wahl et al. | 30/43.2 |
| 5,093,307 | A * | 3/1992 | Kunz et al. | 503/227 |
| 5,259,116 | A | 11/1993 | Laube | |
| 5,325,590 | A * | 7/1994 | Andis et al. | 30/216 |
| 5,341,570 | A * | 8/1994 | Kumakawa | 30/43.6 |
| 5,402,576 | A * | 4/1995 | Kiyooka et al. | 30/216 |
| 5,606,799 | A * | 3/1997 | Melton | 30/216 |
| 5,678,312 | A | 10/1997 | Watanabe | |
| 5,797,925 | A | 8/1998 | Heintke | |
| 5,819,415 | A * | 10/1998 | Bruggers et al. | 30/223 |
| 6,076,263 | A * | 6/2000 | Andis et al. | 30/216 |
| 6,248,007 | B1 * | 6/2001 | deBlois et al. | 451/344 |
| 6,672,402 | B2 * | 1/2004 | Ortt et al. | 173/1 |
| 7,080,458 | B2 * | 7/2006 | Andis | 30/223 |
| 7,328,904 | B2 * | 2/2008 | Schell et al. | 279/60 |
| 7,343,841 | B2 * | 3/2008 | Phillips et al. | 83/481 |
| 7,360,312 | B2 * | 4/2008 | Warashina et al. | 30/276 |
| 7,624,506 | B2 * | 12/2009 | Melton et al. | 30/216 |
| 7,818,864 | B2 * | 10/2010 | Wilkinson et al. | 29/428 |
| 7,827,695 | B1 * | 11/2010 | Kim | 30/43.3 |
| 7,832,319 | B2 * | 11/2010 | Phillips et al. | 83/481 |
| 7,992,303 | B2 | 8/2011 | Liao | |
| 8,146,254 | B2 * | 4/2012 | Morisugi et al. | 30/43.92 |
| 8,533,962 | B1 * | 9/2013 | Laube | 30/210 |
| 2002/0108251 | A1 * | 8/2002 | Brum et al. | 30/43.7 |
| 2004/0237308 | A1 * | 12/2004 | Mitchell et al. | 30/43.6 |
| 2005/0000095 | A1 * | 1/2005 | Warashina et al. | 30/276 |
| 2005/0060893 | A1 * | 3/2005 | Comminges | 30/216 |
| 2005/0262694 | A1 * | 12/2005 | Ouchi et al. | 30/43.92 |
| 2005/0262695 | A1 * | 12/2005 | Ouchi et al. | 30/43.92 |
| 2007/0050991 | A1 * | 3/2007 | Mooney et al. | 30/210 |
| 2007/0234572 | A1 * | 10/2007 | Hannan et al. | 30/43.92 |
| 2008/0178468 | A1 | 7/2008 | Liao | |
| 2008/0263871 | A1 | 10/2008 | Liao | |
| 2009/0100684 | A1 * | 4/2009 | Doragrip et al. | 30/216 |
| 2010/0215453 | A1 * | 8/2010 | Ceroll et al. | 409/182 |
| 2010/0257917 | A1 * | 10/2010 | Tinker et al. | 73/11.01 |
| 2011/0005080 | A1 * | 1/2011 | Ouchi et al. | 30/43.91 |
| 2012/0090182 | A1 * | 4/2012 | Heerlein et al. | 30/228 |
| 2012/0151778 | A1 * | 6/2012 | Svennung | 30/216 |
| 2012/0167394 | A1 * | 7/2012 | Lugert et al. | 30/216 |
| 2013/0008676 | A1 * | 1/2013 | Eshleman et al. | 173/1 |
| 2013/0186660 | A1 * | 7/2013 | Eshleman et al. | 173/1 |
| 2013/0306341 | A1 * | 11/2013 | Rudolph et al. | 173/48 |

FOREIGN PATENT DOCUMENTS

| | | |
|---|---|---|
| DE | 44 28 892 | 2/1996 |
| DE | 195 39 687 | 5/1996 |
| DE | 602 07 888 | 8/2006 |
| DE | 20 2007 001 336 | 7/2007 |
| GB | 1 910 10 040 | 0/1911 |
| GB | 1 021 615 | 3/1966 |
| GB | 2 378 407 | 2/2003 |
| WO | 03/053641 | 7/2003 |
| WO | 2010/017009 | 2/2010 |

* cited by examiner

ANIMAL SHEARING MACHINE

This application is a continuation of international application number PCT/EP2010/054940 filed on Apr. 15, 2010 and claims the benefit of German application number 10 2009 017 517.2 filed on Apr. 20, 2009 and German application number 10 2009 045 545.0 filed on Oct. 9, 2009.

The present disclosure relates to the subject matter disclosed in international application number PCT/EP2010/054940 of Apr. 15, 2010 and German applications number 10 2009 017 517.2 of Apr. 20, 2009 and number 10 2009 045 545.0 of Oct. 9, 2009, which are incorporated herein by reference in their entirety and for all purposes.

BACKGROUND OF THE INVENTION

The invention relates to an animal shearing machine.

Electrically operated animal shearing machines of different constructions have been known from the state of the art for a long time.

For example, DE 11 96 994 A describes an animal shearing machine which is driven by an electric motor. The housing of the device, which serves at the same time as a handle, has a shearing head at the front end. The shearing head consists of a stationary cutting comb and a movable cutting comb which oscillates back and forth in relation to the stationary cutting comb. The movable cutting comb is held and driven by a fork which is movable back and forth about a joint. The drive of the movable cutting comb is brought about by the use of an eccentric in a manner which is, in the meantime, well-known. With the aid of the eccentric, the rotational movement of a driving electric motor can be transformed into the desired oscillating movement of the shearing head. The eccentric engages for this purpose in a slot in the fork which is mounted so as to be movable. Since considerable drive moments are required in the case of animal shearing machines on account of the thickness of the hair and the density of the coat of the animals, the drive moment of the electric motor used is transferred to the eccentric via a reduction gear. In the case of the animal shearing machine disclosed in DE 11 96 994 A, a spur gear is used for this purpose. The drive unit consisting of electric motor, gear, eccentric and oscillating fork is accommodated completely within the housing of the animal shearing machine. The electric motor is mounted in the housing in such a manner that the shaft of the electric motor is arranged in the direction of the longitudinal axis of the housing. Drive shaft and driven shaft of a spur gear extend parallel at a distance to one another. The axis of oscillation of the eccentric connected to the driven shaft of the spur gear is aligned approximately at right angles to the fork connected to the movable cutting comb.

The use of a spur gear does, however, entail certain disadvantages. Spur gears are, on the one hand, well known to be relatively loud. On the other hand, the spatial requirements for a spur gear are relatively large, for which reason the housing of the animal shearing machine cannot be constructed in accordance with the ergonomic points of view or requirements which apply today when a spur gear is used or the required reduction is not achieved. The spur gear shown in DE 11 96 994 A is, in addition, mounted on the housing in a complicated manner.

In the meantime, it is now common to use a worm gear instead of the spur gear. In this respect, the shaft of the electric motor is generally aligned such that it extends at an angle to the longitudinal axis of the housing. The worm wheel, which is connected to the driven shaft and the eccentric, is driven by the electric motor via a worm which is connected to the motor shaft. The axis of the eccentric connected to the worm wheel is approximately at right angles to the longitudinal axis of the housing and, as a result, extends approximately parallel to the axis of oscillation of an oscillating lever which is used in the meantime instead of the fork described in DE 11 96 994 A in order to drive the movable cutting comb of the shearing head. It is also no longer obligatory to connect the oscillating lever and cutting comb rigidly to one another but rather they are normally in entraining engagement.

The advantages of a worm gear include, above all, a high possible reduction with low space requirements as well as a low level of noise during operation. Worm gears are, in addition, of a relatively simple construction. Occasionally, however, significant problems do result during the use of a worm gear. For example, worm gears have a high sliding friction which leads to considerable wear and tear and considerable heating up. As a result, the degree of efficiency of the overall drive unit is relatively bad. The considerable heating up leads to the equipment not being operable on a continuous basis and, therefore, interruptions become necessary since the equipment becomes too hot both for the person as well as for the animal. As a result of the low degree of efficiency it is also difficult to realize battery-driven animal shearing machines since the service life of a battery of a justifiable size for the shearing procedure is not adequate.

It is, therefore, the object of the present invention to provide an animal shearing machine which operates with better energy efficiency and is, therefore, also suitable for battery operation with adequately long operating times.

SUMMARY OF THE INVENTION

The object is accomplished by the features of claim 1 of the present invention.

The use of a planetary gear for the animal shearing machine according to the invention offers various advantages. On the one hand, the gear operates with a high degree of efficiency which is clearly improved in comparison with the gears used up to now in the state of the art. In the case of battery operation, this allows considerably extended, uninterrupted operating cycles. Connected with the high degree of efficiency is also a low degree of heating up which is essentially negligible, scarcely measurable and allows a long, uninterrupted operation with the shearing machine according to the invention. With the same shearing capacity, the animal shearing machine according to the invention requires a considerably reduced drive capacity.

The planetary gear used in accordance with the invention can, in addition, be realized with an extremely small constructional space and, therefore, be accommodated in the housing of the animal shearing machine according to the invention in a space-saving manner.

In addition, the animal shearing machine according to the invention differs from those of the state of the art due to less noise being generated.

Furthermore, the driven shaft of the planetary gear in the animal shearing machine according to the invention can be arranged parallel, in particular, coaxially, to the shaft of the electric motor.

An additional advantage is the fact that housing shells of shearing machines driven by a worm gear can be used, the inner structure of which has merely to be modified slightly. The external appearance of an existing and proven product can, therefore, be retained as required. Also, many additional parts of an existing animal shearing machine construction can be used, as well.

Planetary gears which are designed as a one-step gear are particularly advantageous.

The use of a planetary gear as reduction gear enables the shaft of the electric motor and the driven shaft of the planetary gear to be arranged, in particular, coaxially. This makes the integration of motor and reduction gear to form a constructional unit, a motor/gear unit, easier.

In order to realize a mode of operation which is low in vibration, it may be provided in the animal shearing machine according to the invention for the motor/gear unit to be mounted in the housing, or the two housing shells typically used, by means of one or more elastically deformable bearing elements. In this case, rubber rings can be advantageously used, in particular in the form of O-rings.

As a result of the elastically deformable bearing elements, the operational noise of the animal shearing machine during operation will be reduced further, on the one hand, and, on the other hand, vibrations which are unpleasant for the user of the animal shearing machine during operation are more or less precluded.

In one advantageous development of the animal shearing machine according to the invention, the motor/gear unit comprises a flange, on which at least one rubber ring is arranged. The flange is preferably designed such that it serves as a spacer element between the planetary gear and the housing. In this respect, it is favorable when the flange is aligned essentially at right angles to the axis of the driven shaft.

The flange is preferably arranged in the area of the planetary gear and is, with its dimensions, somewhat broader than the planetary gear itself. At least one of the rubber rings which are used for mounting the motor/gear unit in the housing is located between gear flange and housing. The gear flange therefore serves as a spacer element between planetary gear and housing. As a result, a circulation of air between housing and planetary gear or rather electric motor is made possible. This serves the purpose of the housing, which serves as a handle of the animal shearing machine, not becoming heated in some parts to a considerable degree.

In the case of the planetary gear, a reduction ratio in the range of approximately 2:1 to 8:1, even more preferred of approximately 4:1 to 5:1 is preferably selected. A reduction ratio of approximately 4.4:1 has proven to be favorable, in particular.

With a reduction ratio in the preferred range, an optimum compromise between a high torque and a high degree of efficiency or low heat is achieved. The shearing machine according to the invention may be combined with shearing heads of different designs. Particularly preferred are, however, shearing heads, with which the drivable shearing blade can be driven oscillatingly in relation to an, in particular, linear movement, wherein the driven shaft of the planetary gear is coupled to the drivable shearing blade via an eccentric and an oscillating lever.

In this embodiment of the invention, it is even more preferred when the oscillating lever has a front end which is coupled to the drivable shearing blade and a rear end which comprises a sliding element, with which the eccentric engages. The oscillating lever is mounted on the housing in an area between the front and the rear ends so as to be rotatable about an axis of oscillation.

The driven shaft of the planetary gear is preferably arranged at right angles to the axis of oscillation of the eccentric. This ensures, on the one hand, a compact mode of construction; on the other hand, the frictional losses which are generated between the eccentric and the oscillating lever as well as in the mounting of the oscillating lever about the axis of oscillation can be kept low as a result.

The more precisely the oscillating lever is mounted, the lower the frictional losses during the transfer of power from the drive shaft of the reduction gear to the drivable shearing blade and the shearing performance of the shearing head is all the better.

The oscillating lever has a key function in the transfer of power and is stressed to an extremely great extent. For this reason, the oscillating lever is preferably produced from a material which is low in wear and tear, preferably a steel alloy, for example a steel alloy with Cu and Mo as alloy components. The steel alloys preferably have a hardness of approximately 60 Rockwell.

It is even more preferred when the oscillating lever is manufactured as a sintered metal part, preferably from sintered metal alloys of the standard type SINT D39.

Further improvements in the properties of the oscillating lever may be achieved when the oscillating lever is provided with a thin plastic coating. Polymer materials on the basis of highly fluorinated hydrocarbons, for example PTFE and TFE copolymers, are suitable, in particular, as plastic materials.

It is of significance, in addition, for the interruption-free continuous operation of the animal shearing machine according to the invention for the mounting of the oscillating lever on its axis of oscillation to be brought about essentially free of clearance, in particular in an axial direction.

For this purpose, a groove, into which a securing disk can be locked, can be provided, for example, on the axis of oscillation. As a result, the oscillating lever can be held on the axis of oscillation essentially free of any axial clearance. This has a positive effect on the appearance of the cut generated by the shearing head and so an optimum shearing result from an optical point of view can be achieved with a minimized amount of time.

The driven shaft of the planetary gear is preferably aligned parallel to the longitudinal axis of the housing. In this respect, it is of particular advantage when the driven shaft of the planetary gear is aligned essentially coaxially to the longitudinal axis of the housing. This also contributes to a compact mode of construction of the animal shearing machine and, therefore, ensures that existing housing shells of animal shearing machines with worm gears can be used.

The eccentric is advantageously formed by an eccentric cam, in particular a cylindrical eccentric cam, the axis of which extends parallel to the driven shaft of the gear.

The sliding element of the oscillating lever, in which the eccentric connected to the driven shaft of the planetary gear engages, is preferably formed by a groove which extends at right angles to the driven shaft of the planetary gear and parallel to the axis of oscillation of the oscillating lever. As a result, a flawless transfer of power between eccentric and oscillating lever is ensured.

The surfaces of the groove walls are preferably designed to be convexly curved, in particular cylindrically, so that the groove walls are each in contact with the preferably cylindrical eccentric cam only at one point. Contact results each time only between the eccentric cam and one of the two groove walls, depending on the direction of oscillation, on account of the clearance fit between eccentric and groove. The frictional losses between eccentric and oscillating lever are, therefore, minimized which results in an additional improvement in the degree of efficiency as well as even less heating up of the animal shearing machine during operation.

The shearing head is preferably held on the housing via a releasable connection. In this respect, the driven shaft of the reduction gear is releasably coupled to the drivable shearing blade. In this respect, it is preferably provided for the front end of the oscillating lever and the drivable shearing blade to engage in one another.

In the case of the animal shearing machine according to the invention, a direct current motor is preferably used as electric motor, wherein the direct current motor can preferably be operated with rotational speeds in the range of approximately 5,000 to 17,000 $min^{-1}$, preferably approximately 8,000 to 13,000 $min^{-1}$, even more preferred in the range of approximately 9,000 to 11,000 $min^{-1}$.

Particularly preferred direct current motors are equipped with precious metal brushes. This ensures a long service life.

Alternatively, motors without brushes, which are to be adjudged even more favorably from the point of view of maintenance, can be used.

Electric motors with a motor power of approximately 8 to approximately 12 Watts, in particular approximately 10 Watts, have proven to be favorable, in particular for battery operation, as well.

The animal shearing machine according to the invention is suitable, in particular, for battery operation and, therefore, preferably comprises an energy source in the form of a battery which can preferably be exchanged. Li-ion batteries are suitable, in particular, since they have a high energy density.

In the following, one preferred embodiment of the present invention will be explained in greater detail on the basis of drawings.

DETAILED DESCRIPTION OF THE INVENTION

Figure 1:
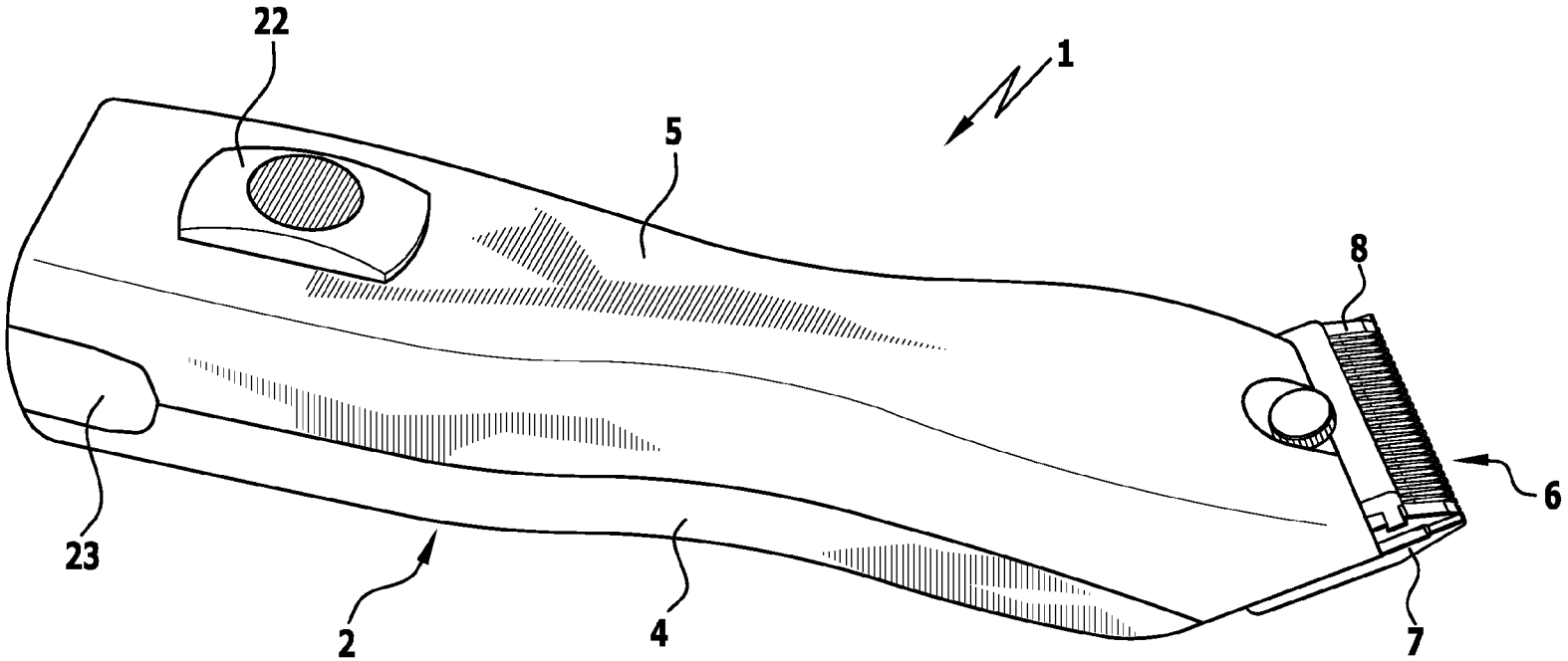
FIG. 1 shows a perspective view of an animal shearing machine according to the invention.

The following applies for the additional comments: If reference numerals are included in a Figure but are not mentioned further in the associated description of the Figure, reference is made to their explanation from preceding descriptions of the Figures.

FIG. 1 shows an oblique view of an animal shearing machine 1 according to the invention. The housing 2 of the animal shearing machine 1 consists of a housing lower shell 4 and a housing upper shell 5. The housing 2 is shaped in an ergonomically waisted manner and serves as a handle with the shearing head 6 attached to its front end. The shearing head 6 is aligned at a slight upward angle from the housing lower shell 4 to the housing upper shell 5, likewise in accordance with ergonomic points of view. The stationary shearing blade 7 of the shearing head 6 is rigidly but releasably connected to the housing 2. The movable shearing blade 8, which is arranged over the stationary shearing blade 7, may be moved back and forth in a linear movement in relation to the stationary shearing blade 7 in the known manner. The switch with the reference numeral 22 and the cover of the battery compartment with the reference numeral 23 are provided as additional elements.

Figure 2:
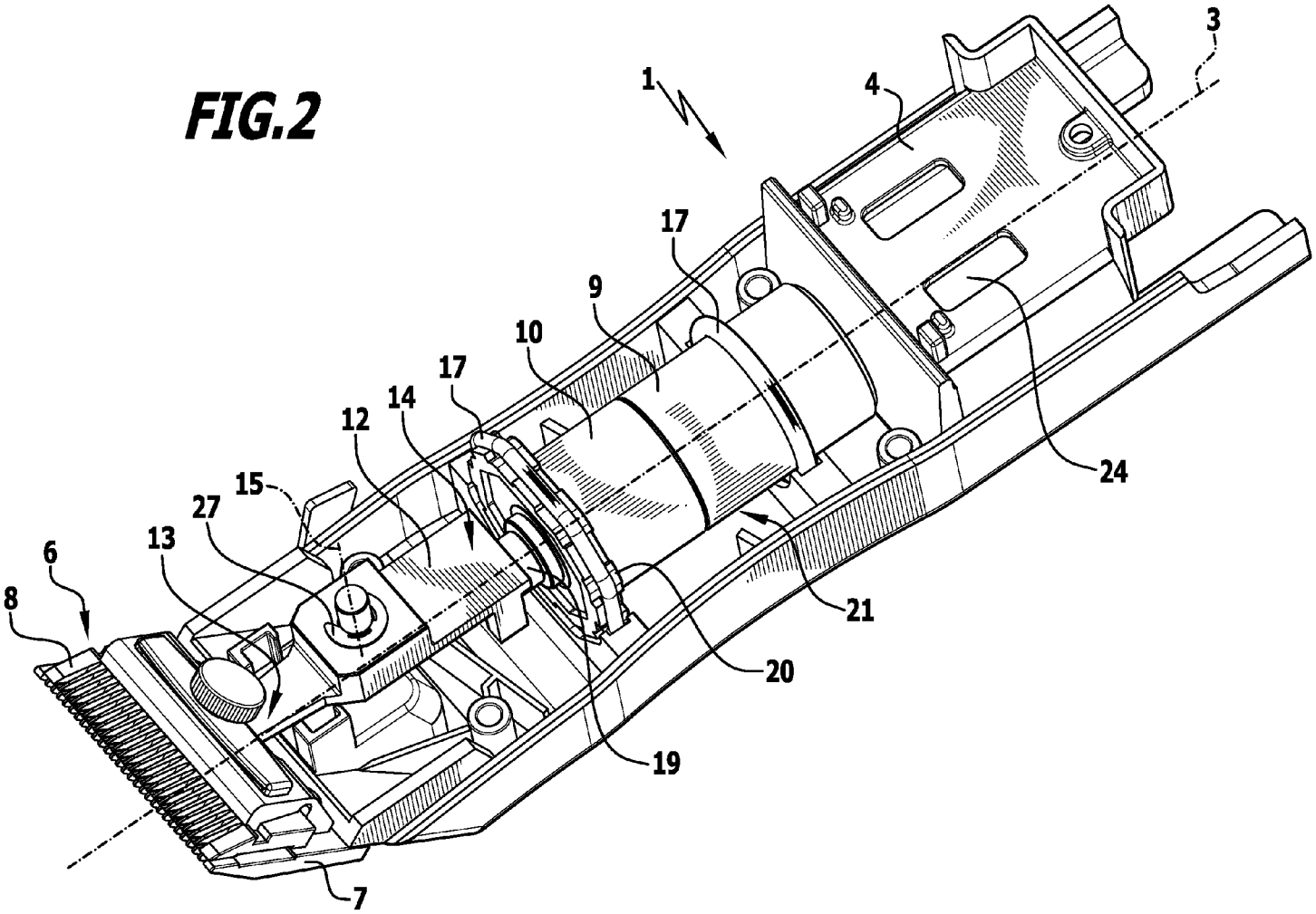
FIG. 2 shows a perspective view of the animal shearing machine from FIG. 1 with a housing upper shell lifted away.

FIG. 2 shows an additional oblique view of the animal shearing machine 1 according to the invention from FIG. 1, wherein in FIG. 2 the upper shell of the housing is not illustrated in order to enable the internal workings of the animal shearing machine 1 to be viewed. The cover 23 of the battery compartment 24 is likewise omitted.

The movable shearing blade 8 is driven by the drive unit 21 which consists of the components electric motor 9, planetary gear 10, an eccentric and the oscillating lever 12. The drive unit 21 is shown again separately in FIG. 3. Here, the eccentric is provided with the reference numeral 11. The oscillating lever 12 is rotatably mounted via the axis of oscillation 15, which is formed by a shaft, not only in the housing lower shell 4 but also in the housing upper shell 5 which is not illustrated and so it can oscillate back and forth about the axis of oscillation 15. The axis of oscillation 15 is aligned at right angles to the longitudinal axis 3 of the housing 2 and is located approximately in the center of the oscillating lever 12. The movable shearing blade 8 (also called upper plate in the following) is in entraining engagement with the first front end 13 of the oscillating lever 12. The oscillating lever 12 is driven by the eccentric 11 illustrated in FIG. 3 in the area of the second lower end 14. The eccentric 11 is seated on the driven shaft 19 of the planetary gear 10 which is connected to the electric motor 9 to form a motor/gear unit. The shaft of the electric motor 9 is aligned coaxially to the drive shaft and to the driven shaft 19 of the planetary gear 10. Electric motor 9 and planetary gear 10 have the same external diameter and form, as a result, a very compact motor/gear unit. A flange 20 is attached to the end of the planetary gear 10 pointing in the direction of the shearing head 6 and this flange can be produced, for example, as a pressure die casting part.

The motor/gear unit is mounted in the housing via two rubber O-rings 17. One rubber O-ring 17 is located between the housing and the flange 20. The flange 20 forms a spacer element of the planetary gear 10 in relation to the housing, wherein a circulation of air around the planetary gear 10 and the electric motor 9 is made possible. The motor/gear unit consisting of planetary gear 10 and electric motor 9 is aligned coaxially to the longitudinal axis 3 of the housing 2, whereby a housing shape which is extremely slim and ergonomically formed is possible. The battery compartment of the animal shearing machine 1 according to the invention is provided with the reference numeral 24.

Figure 3:
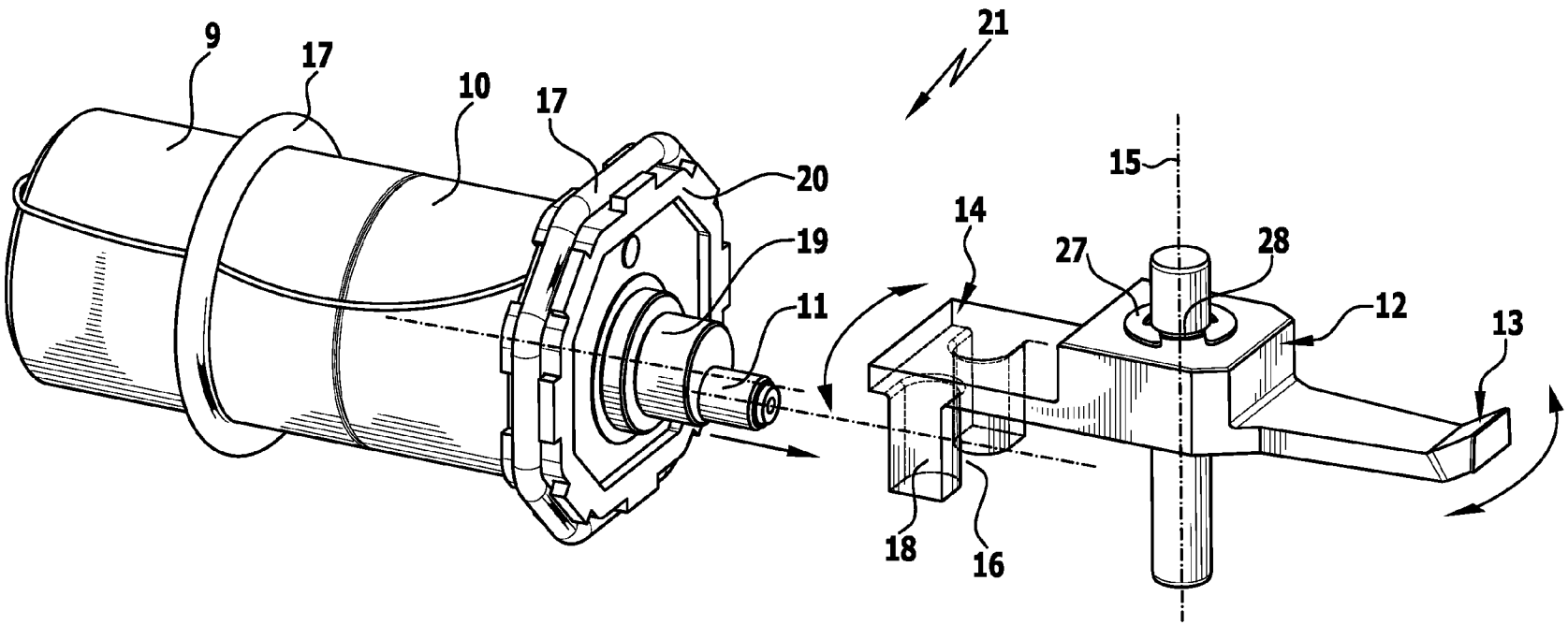
FIG. 3 shows a perspective exploded illustration of the drive unit of the animal shearing machine of FIGS. 1 and 2, this unit consisting of electric motor, planetary gear, eccentric and oscillating lever.

In FIG. 3, the drive unit 21 of the animal shearing machine according to the invention from FIGS. 1 and 2, consisting of electric motor 9, planetary gear 10, eccentric 11 and oscillating lever 12, is illustrated in an exploded oblique view. The eccentric 11 of the drive unit 21 is formed by a cylindrical eccentric cam, the axis of which extends parallel and eccentrically to the axis of the driven shaft 19 of the planetary gear 10. The eccentric cam is mounted on the driven shaft 10 so as to be rotatable about its axis. The eccentric cam engages in a groove 16 of the oscillating lever 12. For the purpose of illustration, the oscillating lever 12 has been moved forwards along the axis of the driven shaft 19. The groove 16 is accommodated in a projection 18 in the area of the rear end 14 of the oscillating lever 12 and extends at right angles to the axis of the driven shaft 19 and parallel to the axis of oscillation 15. The walls of the groove 16 have cylindrical surfaces, whereby only one point of contact results each time between the eccentric cam and the groove walls.

The eccentric cam is approximately as wide as the groove 16 but a clearance fit exists between eccentric cam and groove 16. The eccentric cam rolls along the cylindrical walls of the groove 16 as it is mounted on the driven shaft 19 so as to be rotatable about its own axis. The frictional losses, which result from the engagement of the eccentric cam with the oscillating lever 12 during the conversion of a rotational movement of the driven shaft 19 into an oscillating movement of the oscillating lever 12, are thus kept small. In FIG. 3, it is also apparent that the motor/gear unit consisting of electric motor 9 and planetary gear 10 can be mounted non-rotatably in the housing of the animal shearing machine without additional attaching means as a result of the octagonal and slightly rounded design of the flange 20.

Figure 4:
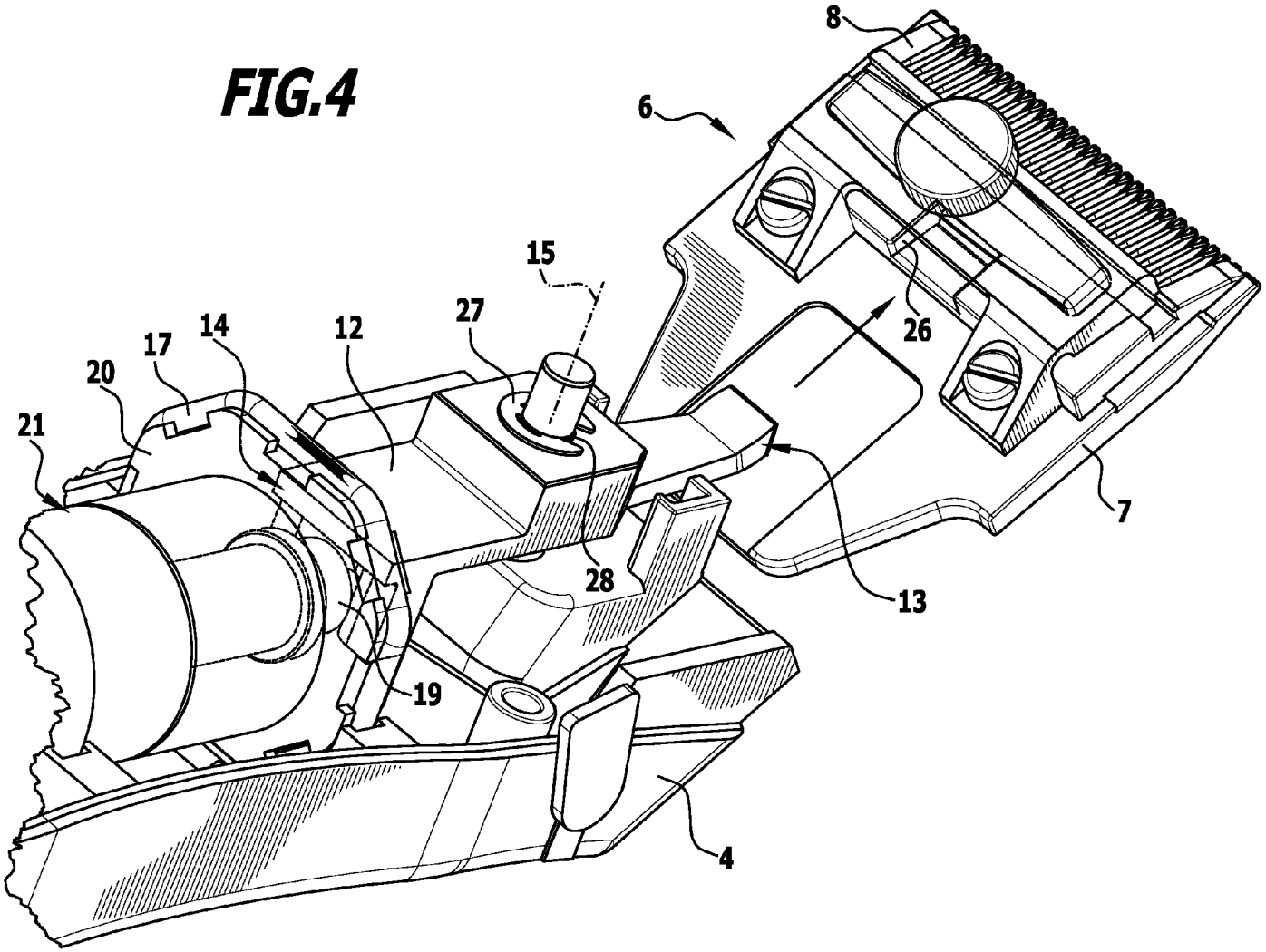
FIG. 4 shows a partial plan view of the animal shearing machine of FIG. 2 with a housing upper shell removed.

The mode of operation of the animal shearing machine 1 according to the invention will be explained in somewhat greater detail on the basis of FIG. 4.

The oscillating lever 12 drives the shearing head 6 in that it engages in the recess 26 provided accordingly in the upper plate 8 of the shearing head 6 and moves the upper plate 8 back and forth in quick succession in the horizontal (horizontal oscillation). The nominal speed of this procedure is, for example, 2,300 strokes per minute. The oscillating lever 12 therefore represents the medium which transfers the power of the drive unit of the shearing machine directly to the shearing head 6. The more precisely the oscillating lever 12 can perform this transfer of power, the lower the frictional losses which can occur during this process and the better the cutting capacity of the shearing head 6. The oscillating lever 12 is stressed to an extremely great extent as a result of this key function during the transfer of power. For this reason, the oscillating lever 12 is produced from a material which is more or less free from wear and tear. The best results for continuous operation were achieved with a special sintered metal alloy of the standard type SINT D39.

During continuous stressing, an axial clearance of the oscillating lever could occur, i.e. the oscillating lever "migrates" back and forth on the axis 15 during great stressing. In order to alleviate this problem, a securing disc 27 pushed onto the axis 15 is provided and engages in the groove 28 of the axis 15 and, as a result, keeps the oscillating lever 12 permanently in its optimum position. As a result of this measure, the maximum transfer of power from the drive unit to the shearing head 6 is permanently ensured, even during continuous operation.

It should be noted that the cutting capacity and, therefore, the appearance of the shorn animal skin depends primarily on the shearing head used. This means that the better the shearing head 6 can function, the better the result, when seen not only from a visual point of view but also with respect to time. The time which will be required to achieve a specific shearing result is a decisive criterion with respect to the economic efficiency of the shearing machine, above all for the professional user.

The invention claimed is:

1. Animal shearing machine comprising:
a housing,
a shearing head held on the housing, and
a drive unit arranged in the housing,
wherein:
the drive unit comprises an electric motor with a shaft and a reduction gear coupled to the shaft of the drive motor and having a driven shaft,
the shearing head has a stationary shearing blade and a shearing blade drivable for movement relative to the stationary shearing blade,
the driven shaft of the reduction gear is coupled to the drivable shearing blade,
the reduction gear is a planetary gear and the driven shaft of the reduction gear is arranged parallel to the shaft of the electric motor,
the drivable shearing blade is drivable oscillatingly and the driven shaft of the planetary gear is coupled to the drivable shearing blade via an eccentric cam and an oscillating lever,
the oscillating lever has a front end coupled to the driveable shearing blade and a rear end comprising a sliding element,
the oscillating lever is manufactured as a sintered metal part,
the sliding element is designed as a groove extending at right angles to the driven shaft of the planetary gear and parallel to an axis of oscillation of the oscillating lever, and
the groove has groove walls with convexly curved semicylindrical surfaces, each surface being in contact with the eccentric cam only at one point.

2. Animal shearing machine as defined in claim 1, wherein the planetary gear is a one-step gear.

3. Animal shearing machine as defined in claim 1, wherein the driven shaft of the planetary gear is arranged coaxially to the shaft of the electric motor.

4. Animal shearing machine as defined in claim 1, wherein the driven shaft is arranged parallel to a longitudinal axis of the housing.

5. Animal shearing machine as defined in claim 1, wherein the drive unit, which comprises the electric motor, and the planetary gear combine to form a motor/gear unit.

6. Animal shearing machine as defined in claim 5, wherein the motor/gear unit is mounted in the housing by means of elastically deformable bearing elements.

7. Animal shearing machine as defined in claim 6, wherein the bearing elements comprise at least two rubber rings arranged between the motor/gear unit and the housing.

8. Animal shearing machine as defined in claim 7, wherein:
the motor/gear unit has a flange in an area of the gear,
one of the rubber rings is arranged on said flange, and
the flange serves as a spacer element between the planetary gear and the housing.

9. Animal shearing machine as defined in claim 8, wherein the flange is arranged essentially at right angles to an axis of the driven shaft of the planetary gear.

10. Animal shearing machine as defined in claim 1, wherein the planetary gear has a reduction ratio in the range of approximately 2:1 to 8:1.

11. Animal shearing machine as defined in claim 1, wherein the oscillating lever is mounted on the housing in a region between the front and rear ends so as to be rotatable about an axis of oscillation.

12. Animal shearing machine as defined in claim 1, wherein the oscillating lever is provided with a coating consisting of a plastic material.

13. Animal shearing machine as defined in claim 1, wherein the axis of oscillation of the eccentric cam is arranged essentially at right angles to the driven shaft of the planetary gear.

14. Animal shearing machine comprising:
a housing,
a shearing head held on the housing, and
a drive unit arranged in the housing,
wherein:
the drive unit comprises an electric motor with a shaft and a reduction gear coupled to the shaft of the drive motor and having a driven shaft,
the shearing head has a stationary shearing blade and a shearing blade drivable for movement relative to the stationary shearing blade, the driven shaft of the reduction gear is coupled to the drivable shearing blade, the reduction gear is a planetary gear and the driven shaft of the reduction gear is arranged parallel to the shaft of the electric motor, the drivable shearing blade is drivable oscillatingly and the driven shaft of the planetary gear is coupled to the drivable shearing blade via an eccentric and an oscillating lever, the oscillating lever is manufactured as a sintered metal part, and the oscillating lever is provided with a coating consisting of a plastic material.

15. Animal shearing machine as defined in claim 1, wherein:

the eccentric cam is essentially of a cylindrical design, an axis of the eccentric cam is arranged essentially parallel to the axis of the driven shaft.

16. Animal shearing machine as defined in claim 1, wherein:

the shearing head is held on the housing via a releasable connection, and the driven shaft is coupled releasably to the drivable shearing blade.

17. Animal shearing machine as defined in claim 16, wherein the front end of the oscillating lever and the drivable shearing blade engage in one another.

18. Animal shearing machine as defined in claim 1, wherein the electric motor is a direct current motor.

19. Animal shearing machine as defined in claim 18, wherein the electric motor is adapted to be operated with a rotational speed in the range of approximately 5,000 to 17,000 $min^{-1}$.

20. Animal shearing machine as defined in claim 18, wherein the direct current motor comprises precious metal brushes.

21. Animal shearing machine as defined in claim 18, wherein the motor is a brushless direct current motor.

22. Animal shearing machine as defined in claim 18, wherein the electric motor has a power input of approximately 8 to approximately 12 Watts.

23. Animal shearing machine as defined in claim 18, further comprising a Li-ion battery.

24. Animal shearing machine as defined in claim 14, wherein the eccentric is formed by an eccentric cam.

25. Animal shearing machine as defined in claim 14, wherein:

the oscillating lever has a front end coupled to the drivable shearing blade and a rear end comprising a sliding element, the eccentric being in engagement with said sliding element, the sliding element is designed as a groove extending at right angles to the driven shaft of the planetary gear and parallel to an axis of oscillation of the oscillating lever.

26. Animal shearing machine as defined in claim 25, wherein the groove has groove walls with convexly curved surfaces, each surface being in contact with the eccentric only at one point.

27. Animal shearing machine as defined in claim 26, wherein the convexly curved surfaces have a cylindrical shape.

* * * * *